US008356738B2

(12) United States Patent
Jiang

(10) Patent No.: US 8,356,738 B2
(45) Date of Patent: Jan. 22, 2013

(54) STAPLE FEEDING APPARATUS FOR SPRING POWERED STAPLERS

(76) Inventor: Peigen Jiang, Sammamish, WA (US)

( * ) Notice: Subject to any disclaimer, the term of this patent is extended or adjusted under 35 U.S.C. 154(b) by 736 days.

(21) Appl. No.: 11/842,952

(22) Filed: Aug. 22, 2007

(65) Prior Publication Data

US 2009/0050666 A1 Feb. 26, 2009

(51) Int. Cl.
*B25C 5/16* (2006.01)

(52) U.S. Cl. ..... 227/120; 227/125; 227/127; 227/128

(58) Field of Classification Search ..... 227/120, 227/123, 125–128
See application file for complete search history.

(56) References Cited

U.S. PATENT DOCUMENTS

| | | | | |
|---|---|---|---|---|
| 4,182,474 | A * | 1/1980 | Sato | 227/99 |
| 4,225,075 | A * | 9/1980 | Chi | 227/119 |
| 4,405,073 | A * | 9/1983 | Salleras Escalante | 227/120 |
| 4,556,161 | A * | 12/1985 | Oide | 227/83 |
| 4,687,098 | A * | 8/1987 | Ebihara | 206/340 |
| 6,076,720 | A * | 6/2000 | Deng | 227/109 |
| 6,494,356 | B1 * | 12/2002 | Frank et al. | 227/127 |
| 6,672,499 | B1 * | 1/2004 | Lee | 227/120 |
| 6,715,657 | B2 * | 4/2004 | Chen | 227/120 |
| 7,240,819 | B2 * | 7/2007 | Chang | 227/132 |
| 7,438,206 | B2 * | 10/2008 | Kumayama | 227/127 |
| 7,681,771 | B2 * | 3/2010 | Kandasamy et al. | 227/134 |
| 2005/0224554 | A1 * | 10/2005 | Kirby et al. | 227/134 |
| 2006/0231583 | A1 * | 10/2006 | Kumayama | 227/134 |
| 2007/0057012 | A1 * | 3/2007 | Kandasamy et al. | 227/134 |
| 2009/0014496 | A1 * | 1/2009 | Kumayama | 227/125 |
| 2010/0264190 | A1 * | 10/2010 | Tsai et al. | 227/128 |
| 2011/0248066 | A1 * | 10/2011 | Hu et al. | 227/127 |

* cited by examiner

*Primary Examiner* — Hemant M Desai
*Assistant Examiner* — Gloria R Weeks

(57) ABSTRACT

This invention provides a safety apparatus for a stapler, the safety apparatus comprises a first plate having a hook and a first opening, wherein when the first plate is in a first position, the hook engages a driving blade for preventing the same from driving out a staple, a second plate substantially parallel to the first plate and having a second opening, a pin having a first and second end, and a first spring urging the pin downward with the first end of the pin protruding from a bottom of a housing body of the stapler and the second end of the pin below the second plate, wherein when the housing body is pressed against an object, the first end of the pin is pushed into the housing body, and the second end of the pin is inserted into both the first and second openings.

11 Claims, 5 Drawing Sheets

STAPLE FEEDING APPARATUS FOR SPRING POWERED STAPLERS

BACKGROUND

The present invention relates generally to staplers, and more specifically, to staple feeding apparatus for spring powered staplers.

A key for a staple to have good penetration is its entry speed. A spring powered stapler uses a spring to store energy. Upon a release of the stored spring energy, a staple can be driven out at a great speed. In traditional staplers reloading a staple magazine can be performed by simply dropping the staple magazine into a top-open staple feeding track. However, spring powered staplers have relatively complicated spring and release components housed above a staple feeding track, therefore, a bottom-open staple feeding track is need.

SUMMARY

In view of the foregoing, the present invention provides.

The construction and method of operation of the invention, however, together with additional objects and advantages thereof will be best understood from the following description of specific embodiments when read in connection with the accompanying drawings.

BRIEF DESCRIPTION OF THE DRAWINGS

The drawings accompanying and forming part of this specification are included to depict certain aspects of the invention. A clearer conception of the invention, and of the components and operation of systems provided with the invention, will become more readily apparent by referring to the exemplary.

DESCRIPTION

Figure 1:
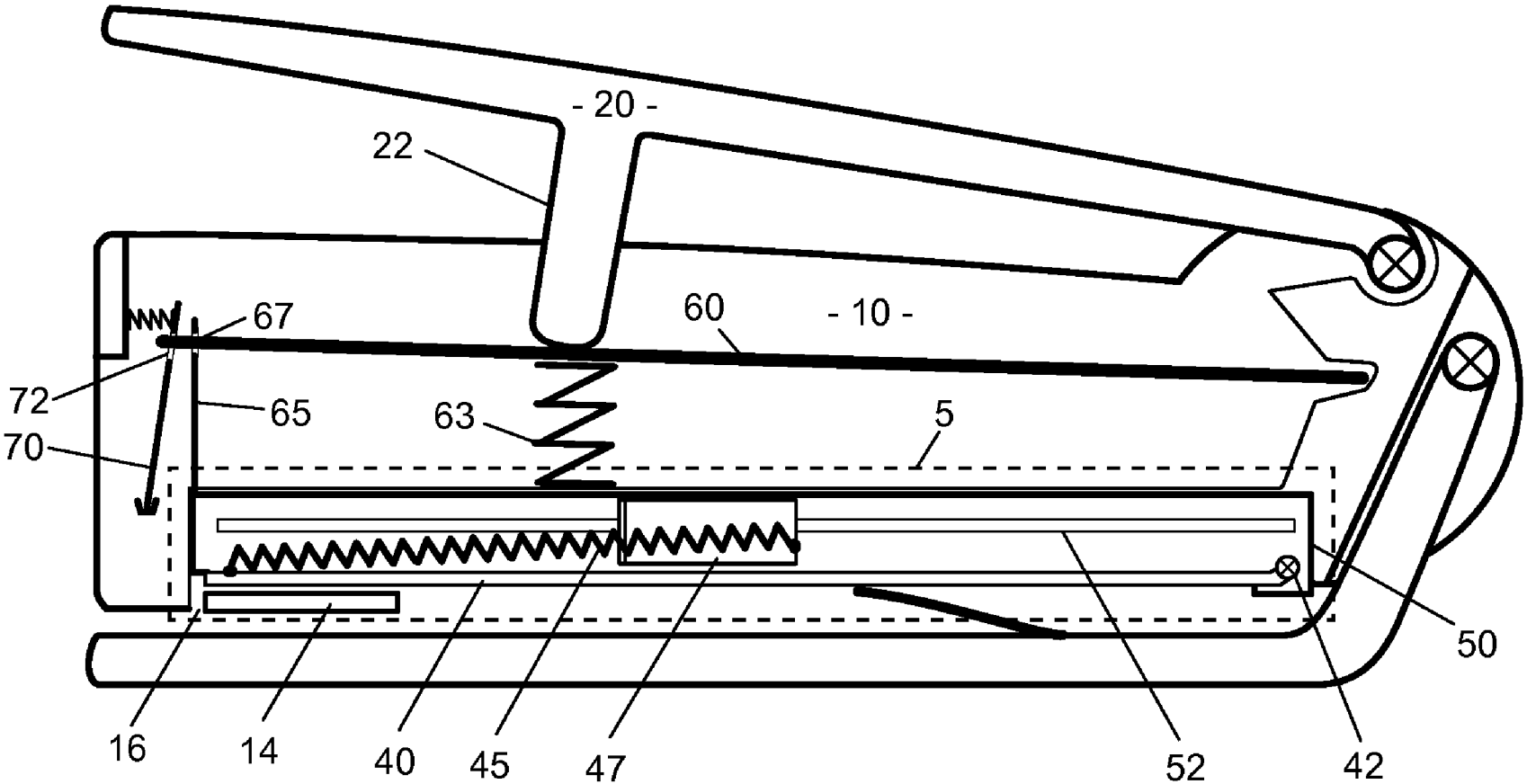
FIG. 1 is a side partial sectional view of a spring powered stapler with a bottom-open staple feeding apparatus in a resting position according to one embodiment of the present invention.

FIG. 1 is a side partial sectional view of a resting spring powered stapler in a substantially horizontal orientation. A staple driving blade 65 and a staple exit slot 16 are located at a front end of a housing body 10 of the spring powered stapler. A handle 20 is on a top and hinged to a rear end of the housing body 10. The present invention provides a bottom-open staple feeding apparatus 5 to the spring powered stapler. The staple feeding apparatus 5 is opened from the bottom of the housing body 10. A staple retention panel 40 is pivotally attached to a rear end of the staple feeding apparatus 5. When the staple feeding apparatus 5 slides forward, the staple retention panel 40 can be withheld by a holding plate 14, so that a staple magazine will be retained in the staple feeding apparatus 5. When the staple feeding apparatus 5 slides backward, the staple retention panel 40 swings to an open position and allows a staple magazine to be dropped in the staple feeding apparatus 5 when the spring powered stapler is held upside down.

Referring again to FIG. 1, the housing body 10 contains a power spring 60 engaging the staple driving blade 65 through a driving blade opening 67 thereon. In the resting position, a front end of the power spring 60 is locked by a lock plate 70 through a lock plate opening 72 thereon. When the handle 20 is pressed down, a push-down rod 22 of the handle 20 forces the power spring 60 to bend, thereby store energy therein. The bending of the power spring 60 causes the front end thereof to withdraw from the lock plate opening 72. After disengaging the lock plate 70, the power spring 60 forces the staple driving blade 60 to move forcefully downward and drive out a staple (not shown) from the staple feeding apparatus 5. When the handle 20 is released. A return spring 63 placed underneath the power spring 60 pushes up the power spring 60 with the front end thereof slides into the lock plate opening 72.

The working of the power spring 60 as described hereinbefore is just one example of numerous ways of constructing a spring powered stapler. The working of the power spring 60 is largely independent of the staple feeding apparatus 5 which will be described in more detail hereinafter.

Figure 2:
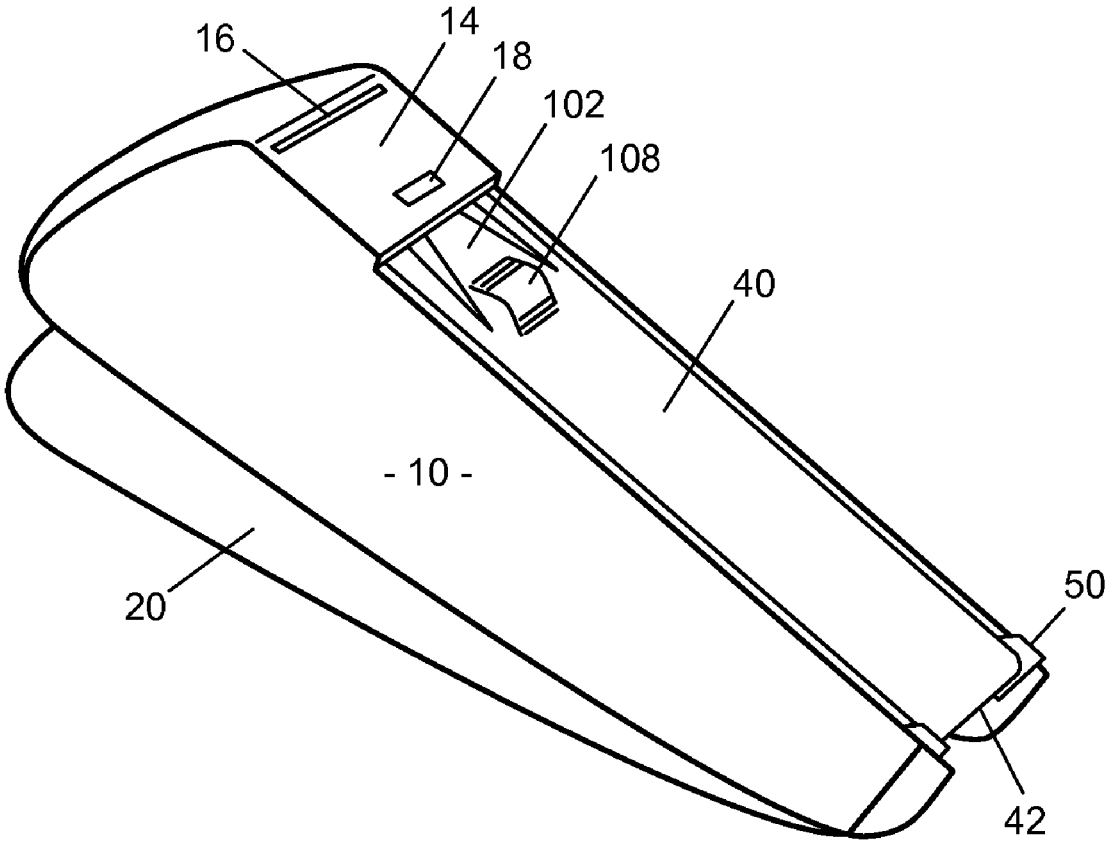
FIG. 2 is a perspective view of the bottom-open staple feeding apparatus of the spring powered stapler of FIG. 1 in a closed and locked position.

FIG. 2 is a perspective view of the bottom-open staple feeding apparatus 5 of the spring powered stapler of FIG. 1 in a closed and locked position. As shown in FIG. 2, the spring powered stapler is placed upside down. A rear end of the staple retention panel 40 is fastened to a shaft 42, which is mounted to a rear end of a U-channel 50. The U-channel 50 is an elongated U shaped channel for containing a staple magazine. The staple retention panel 40 may have approximately the same or slightly bigger width than the U-channel 50. When the staple retention panel 40 is in the closed position, the U-channel 50 is covered by the staple retention panel 40. The U-channel 50 is horizontally slidably contained in the bottom part of the housing body 10. During normal operations, the staple retention panel 40, along with the U-channel 50, is pushed toward the front end of the housing body 10, so that the holding plate 14 prevents the staple retention panel 40 from swinging open when the spring powered stapler is set in an upright position. In order to firmly engage the staple retention panel 40 with the housing body 10, an elastic member 102 is formed on the staple retention panel 40, and a tip of the elastic member 102 snaps into an opening 18 on the holding plate 14. Therefore, the holding plate 14 holds the staple retention panel 40 to the closed position and the elastic member 102 locks the staple retention panel 40 to the closed position. A skilled artisan may realize that the opening 18 on the holding plate 14 may be replaced by a concave member on the inner surface of the holding plate 14.

Referring again to FIG. 2, when the elastic member 102 is pressed down the tip of the elastic member 102 disengages the opening 18, so that the staple retention panel 40, along with the U-channel 50, is free to slide out of the frontal position of the housing body 10.

Figure 3:
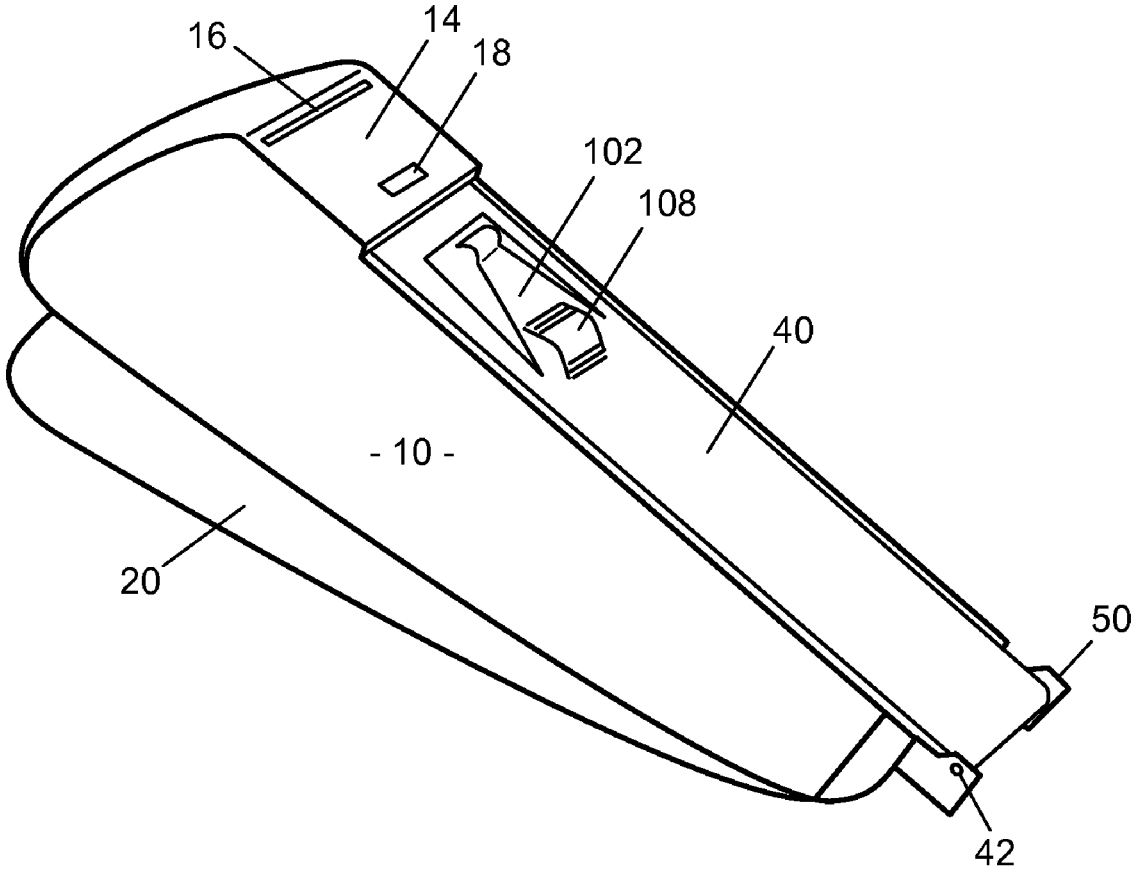
FIG. 3 is a perspective view of the bottom-open staple feeding apparatus of FIG. 1 in an unlocked, yet still closed position.

FIG. 3 is a perspective view of the bottom-open staple feeding apparatus 5 of FIG. 1 in an unlocked, yet still closed position. The tip of the elastic member 102 disengages the holding plate 14, so that the staple retention panel 40 along with the U-channel 50 can be pulled backward. A protruding member 108 on the staple retention panel 40 facilitates the pushing-in or pulling-out of the staple retention panel 40. The staple retention panel 40 can be made of either plastic or sheet metal material. In one embodiment of the present invention, the elastic member 102 may be formed by a separate sheet material with a rear end thereof riveted to the staple retention panel 40. In another embodiment of the present invention, the elastic member 102 may be formed in the same processing step and by the same material, such as plastic, that form the staple retention panel 40.

Figure 4:
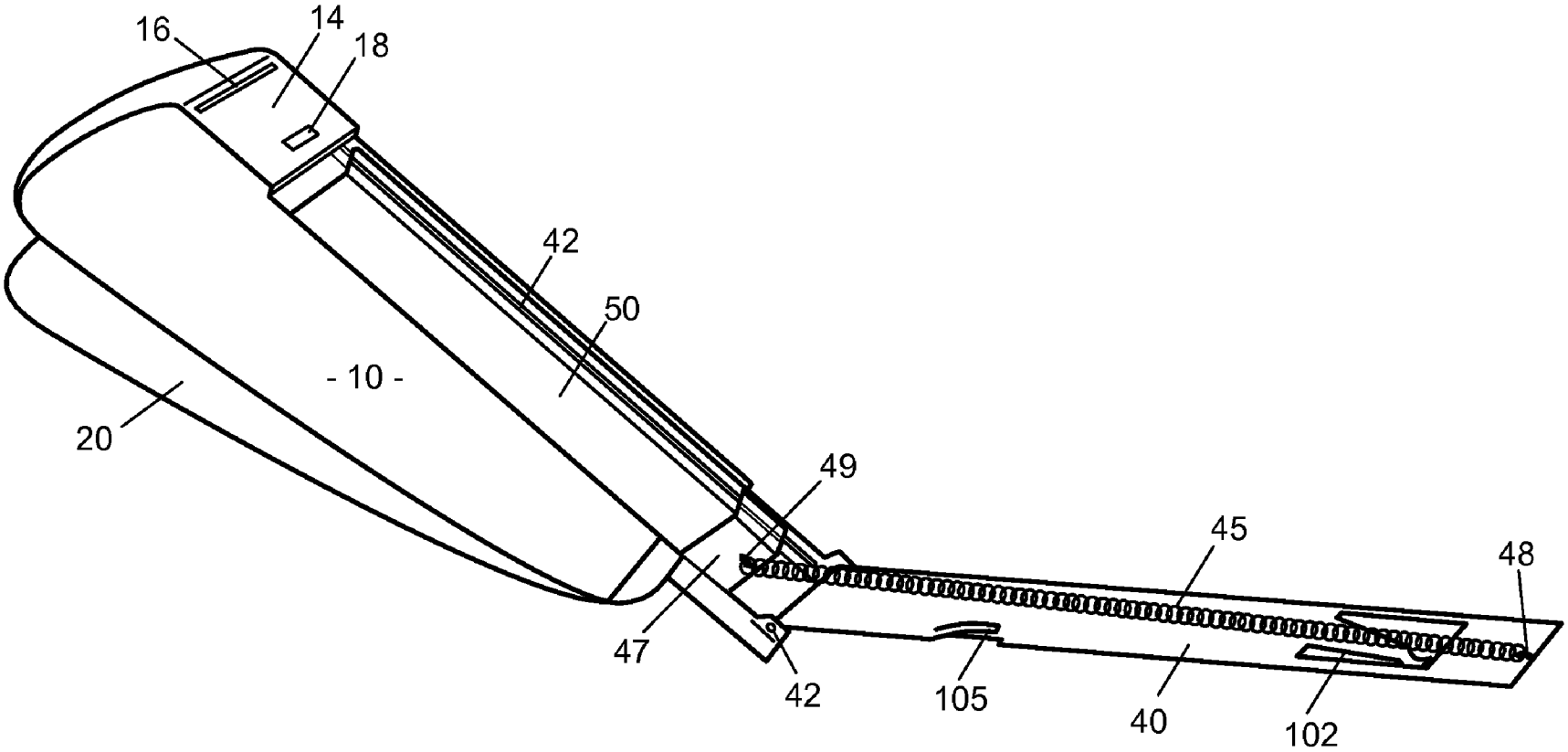
FIG. 4 is a perspective view of the bottom-open staple feeding apparatus of FIG. 1 in an unlocked and opened position.

FIG. 4 is a perspective view of the bottom-open staple feeding apparatus 5 of FIG. 1 in an unlocked and opened position. The spring powered stapler is held upside down. With the staple retention panel 40 along with the U-channel 50 further slides backward, the holding plate 14 can no long hold the front end of the staple retention panel 40. Then a push-up spring 105 pushes the front end of the retention panel 40 away from the U-channel 50. Therefore the staple retention panel 40 can be pulled wide open with an inside thereof facing up as shown in FIG. 4. The push-up spring 105 is formed on an elongated edge of the staple retention panel 40. When the staple retention panel 40 is in the closed position, the push-up spring 105 is pressed against a sidewall of the U-channel 50. A skilled artisan may realize that the push-up spring 105 can be formed on both elongated edges of the staple retention panel 40. In fact, the push up spring 105 may even be formed on the sidewalls of the U-channel 50 instead, pushing up a flat staple retention panel 40.

Referring again to FIG. 4, with the staple retention panel 40 swings to the open position, the U-channel 50 is exposed. The opening of the U-channel 50 is facing upward when the spring powered stapler is held upside down as shown in FIG. 4. Then a magazine of staples can be dropped in the U-channel 50 through the opening thereof. There is a drag spring 45 having a first end 48 mounted on the front end of the staple retention panel 40, and a second end 49 mounted on a sliding block 47. The sliding block 47 is horizontally slidably contained by the U-channel 50. When the staple retention panel 40 swings open, the sliding block 47 is pulled backward by the drag spring 45, so that a large portion of the U-channel 50 is exposed and ready to accept staples. When the staple retention panel 40 swings to the closed position, the sliding block 47 is pulled forward by the drag spring 45 and pushes any staple in the U-channel 50 toward the front end of the housing body 10.

Figure 5A:
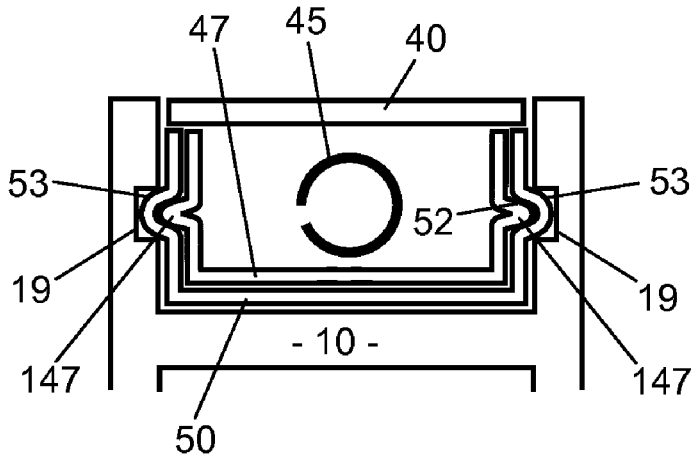
FIGS. 5A and 5B are cross-sectional views of the bottom-open staple feeding apparatus of FIG. 1.
Figure 5B:
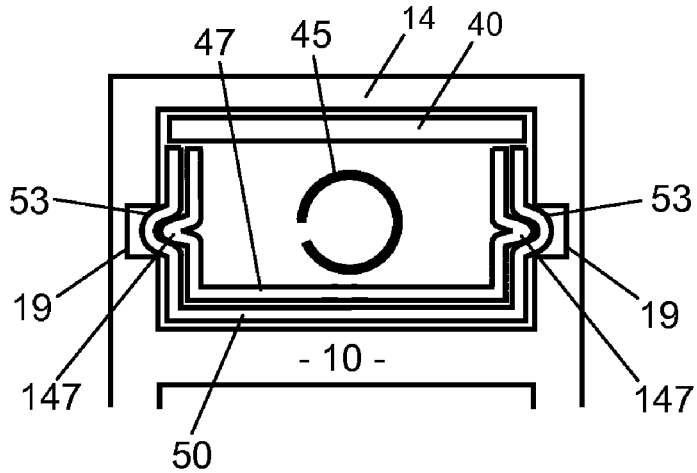

FIGS. 5A and 5B are cross-sectional views of the bottom-open staple feeding apparatus 5 of FIG. 1. Referring back to FIG. 3, FIG. 5A shows a cross-section made at a location A-A', and FIG. 5B shows a cross-section made at a location B-B'. Referring to FIG. 5A, there is a protruding member 147 on an outside surface of each sidewall of the sliding block 47. The protruding member 147 fits in a horizontal concave slot 52 formed on the inside surface of a sidewall of the U-channel 50. The horizontal concave slot 52 runs substantially across the entire elongated length of the U-channel 50. Therefore, the sliding block 47 is slidably contained by the U-channel 50. At the same time of forming the concave slot 52, a protruding bar 53 can be formed on the outside surface of the sidewall of the U-channel 50. The protruding bar 53 fits in a concave channel 19 formed on the inside surface of a sidewall of the housing body 10. Therefore, the U-channel 50 is slidably contained in the housing body 10. The staple retention panel 40 is stopped by the sidewalls of the U-channel 50 and substantially covers the U-channel 50.

Referring to FIG. 5B, the staple retention panel 40 is further retained by the holding plate 14. A skilled artisan may realize that the holding plate 14 does not need to extend from one sidewall to the other. If the middle section of the holding plate 14 is left open, the purpose of holding the staple retention panel 40 can still be achieved. Additionally, there is a substantial gap between the concave channel 19 and the protruding bar 53 at the location B-B' of FIG. 3, because the concave channel 19 at this location needs to accommodate a protruding block 55 (shown in FIG. 6) sticking out from the protruding bar 53. The concave channel 19 is deeper at the location B-B' than at the location A-A'. Shallower concave channel 19 will stop the U-channel 50 from sliding further backward. The deeper portion of the concave channel 19 extends to a predetermined location just to allow the front end of the staple retention panel 40 to slide out of the holding plate 14 so that the staple retention panel 40 can be freely swung open.

Figure 6:
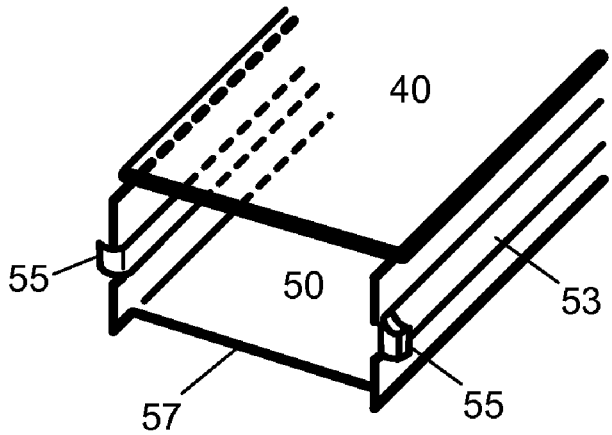
FIG. 6 is a perspective view of a front end of a U-channel staple holder.

FIG. 6 is a perspective view of a front end of the U-channel 50. The protruding block 55 is conveniently formed on the very front of the U-channel 50. The sidewalls of the U-channel 50 are slightly longer than a bottom panel 57 of the U-channel 50 as well as the staple retention panel 40. Therefore, when the sidewalls of the U-channel 50 are pushed against an internal frontal wall of the housing body 10, there are still gaps for a staple (not shown) to exit the U-channel 50 when being struck by the driving blade 65. For this purpose, the sidewalls of the U-channel 50 need to be longer than both the bottom panel 57 of the U-channel and the staple retention panel 40 by at least a wire width of the staple.

The above illustrations provide many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A staple feeding apparatus for a spring powered stapler, the staple feeding apparatus comprising:

a housing body pivotally engaging a separate handle for activating a stapling operation, the handle being situated on a top side of the housing body;

an elongated channel with a U-shaped cross-section slidably engaging side walls of the housing body for containing staples therein, the elongated channel sliding between a first location for the stapling operation and a second location for loading staplers, an opening at the top of the "U" of the elongated channel providing access for staplers therein, the opening being at a bottom side of the housing body;

a covering panel for covering a substantial portion of the opening of the elongated channel, the covering panel having a first end pivotally engaging the elongated channel; and at least one holding member at the bottom of the housing body protruding from an internal side wall of the housing body, the holding member engaging and being beneath a portion of the covering panel when the elongated channel being in the first location, the at least one holding member disengaging the covering panel when the elongated channel being in the second location.

2. The staple feeding apparatus of claim 1, wherein the elongated channel has a first protruding member on each side snugly fits in a grove formed on each internal side wall of the housing body for guiding the elongated channel to slide in the housing body.

3. The staple feeding apparatus of claim 1, wherein the elongated channel has a second protruding member for preventing the elongated channel from sliding off the housing body.

4. The staple feeding apparatus of claim 1, wherein the covering panel has a protruding member for facilitating finger's pushing or pulling the covering panel to slide the elongated channel in the housing body.

5. The staple feeding apparatus of claim 1, wherein the at least one holding member forms a holding panel at the bottom of the housing body.

6. The staple feeding apparatus of claim 5, wherein the holding panel has a concave member for engaging a spring loaded protruding member on the covering panel.

7. The staple feeding apparatus of claim 5, wherein the holding panel has a slot opening for passing a staple.

8. A staple feeding apparatus for a spring powered stapler, the staple feeding apparatus comprising:

a housing body pivotally engaging a separate handle for activating a stapling operation, the handle being situated on a top side of the housing body;

an elongated channel with a U-shaped cross-section slidably engaging side walls of the housing body for containing staples therein, the elongated channel sliding between a first location for the stapling operation and a second location for loading staplers, an opening at the top of the "U" of the elongated channel providing access for staplers therein, the opening being at a bottom side of the housing body;

a covering panel for covering a substantial portion of the opening of the elongated channel, the covering panel having a first end pivotally engaging the elongated channel; and a holding panel formed at the bottom of the housing body across the side walls of the housing body, the holding panel engaging and being beneath a portion of the covering panel when the elongated channel being in the first location, the holding panel disengaging the covering panel when the elongated channel being in the second location.

9. The staple feeding apparatus of claim 8, wherein the elongated channel has a first protruding member on each side snugly fits in a grove formed on each internal side wall of the housing body for guiding the elongated channel to slide in the housing body.

10. The staple feeding apparatus of claim 8, wherein the holding panel has a concave member for engaging a spring loaded protruding member on the covering panel.

11. The staple feeding apparatus of claim 8, wherein the holding panel has a slot opening for passing a staple.

* * * * *